US012312808B2

(12) United States Patent
Coubray et al.

(10) Patent No.: US 12,312,808 B2
(45) Date of Patent: May 27, 2025

(54) BUILDING PANEL

(71) Applicant: SPEEDFLOOR LIMITED, Auckland (NZ)

(72) Inventors: Hamish Oliver Coubray, Auckland (NZ); Nicholas Keith Coubray, Auckland (NZ)

(73) Assignee: SPEEDFLOOR LIMITED, Auckland (NZ)

( * ) Notice: Subject to any disclaimer, the term of this patent is extended or adjusted under 35 U.S.C. 154(b) by 415 days.

(21) Appl. No.: 17/602,129

(22) PCT Filed: Apr. 9, 2020

(86) PCT No.: PCT/IB2020/053377
§ 371 (c)(1),
(2) Date: Oct. 7, 2021

(87) PCT Pub. No.: WO2020/208561
PCT Pub. Date: Oct. 15, 2020

(65) Prior Publication Data

US 2022/0145628 A1 May 12, 2022

(30) Foreign Application Priority Data

Apr. 10, 2019 (NZ) ..... 752527

(51) Int. Cl.
*E04C 2/28* (2006.01)
*E04B 5/02* (2006.01)
(Continued)

(52) U.S. Cl.
CPC ..... *E04C 2/28* (2013.01); *E04B 5/04* (2013.01); *E04B 5/10* (2013.01); *E04C 2/384* (2013.01);
(Continued)

(58) Field of Classification Search
CPC ... E04C 2/28; E04C 2/384; E04C 2/50; E04C 2002/002; E04C 2002/004; E04B 5/04; E04B 5/10; E04B 2103/02; E04B 2103/06
See application file for complete search history.

(56) References Cited

U.S. PATENT DOCUMENTS 414,169 A 10/1889 Reuschel et al.
3,861,104 A 1/1975 Bower
(Continued)

FOREIGN PATENT DOCUMENTS

CA 2796340 C 1/2013
EP 2746016 A1 6/2014
EP 3177779 B1 10/2018

OTHER PUBLICATIONS

Stramit, Stramit Residential Floor Framing System, Product Technical Manual [retrieved from internet on Jul. 1, 2020] <URL: https://www.stramit.com.au/assets/Technical-Resource-Documents/e16e77722d/Residential-Floor-Framing-System-Product-Technical-Manual.pdf> published Oct. 2013 p. 28, figure under the heading Fibre Cement Flooring—Stramit C-Joist and Bearer' on p. 28.
(Continued)

*Primary Examiner* — Gisele D Ford
(74) *Attorney, Agent, or Firm* — JCIP; Joseph G. Chu

(57) ABSTRACT

A building panel for modular construction. The building panel utilises less framework for reduced complexity, materials and weight. The panel utilises features of the formwork to allow the panel to be moved easily. The panel further utilises new formwork moulds that are easier to use and create effective patterns for keying with like panels.

17 Claims, 12 Drawing Sheets

(51) Int. Cl.

| | |
|---|---|
| ***E04B 5/04*** | (2006.01) |
| ***E04B 5/10*** | (2006.01) |
| ***E04C 2/00*** | (2006.01) |
| ***E04C 2/38*** | (2006.01) |

(52) U.S. Cl.
CPC ..... *E04C 2/50* (2013.01); *E04B 2103/02* (2013.01); *E04B 2103/06* (2013.01); *E04C 2002/002* (2013.01); *E04C 2002/004* (2013.01)

(56) References Cited

U.S. PATENT DOCUMENTS

| | | | | |
|---|---|---|---|---|
| 4,495,688 | A * | 1/1985 | Longpre | E04B 5/10 29/460 |
| 7,412,804 | B1 | 8/2008 | Bussinger | |
| 8,453,406 | B2 * | 6/2013 | Platt | E04C 3/294 14/73.1 |
| 2004/0200172 | A1 | 10/2004 | Beck et al. | |
| 2006/0150548 | A1 * | 7/2006 | Bodnar | E04C 3/09 52/262 |
| 2006/0180736 | A1 | 8/2006 | Khoo | |
| 2008/0172976 | A1 | 7/2008 | Carney et al. | |
| 2009/0139176 | A1 | 6/2009 | Schroeder et al. | |
| 2009/0188192 | A1 * | 7/2009 | Studebaker | F16B 25/0094 411/394 |
| 2010/0037551 | A1 * | 2/2010 | Bodnar | E04C 3/09 52/634 |
| 2016/0023374 | A1 | 1/2016 | Kegeris | |

OTHER PUBLICATIONS

Jindal Steel & Power, Speed Floor System [retrieved from internet on Jul. 1, 2020] <URL: http://www.pessi.in/pdf/Day-1-5-Jindal-SFS.pdf > published in 2010 p. 23 and 30, figures on p. 23 and 30.
Jindal Steel & Power Ltd, Jindal Speed Floor [Viewed on internet on Jul. 1, 2020] <URL:https://www. youtube.com/watch?v=-elPyKuntec >Published on Dec. 15, 2016 1:08-1-10 of video Exposed concrete surface at 1:08-1-10 of video.
International Search Report and Written Opinion of International Searching Authority for International Application No. PCT/IB2020/053377.

* cited by examiner

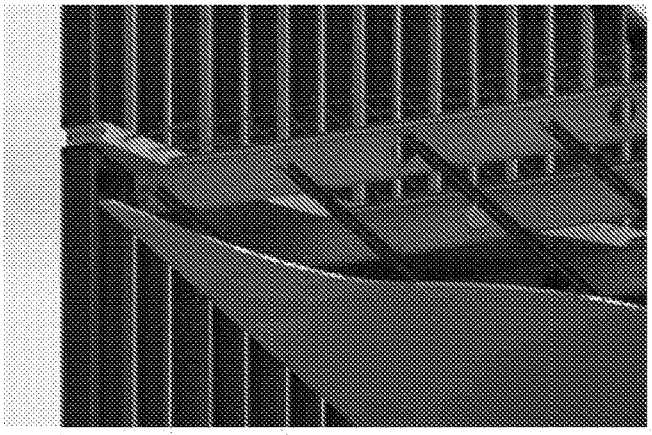
FIGURE 12
FIGURE 13
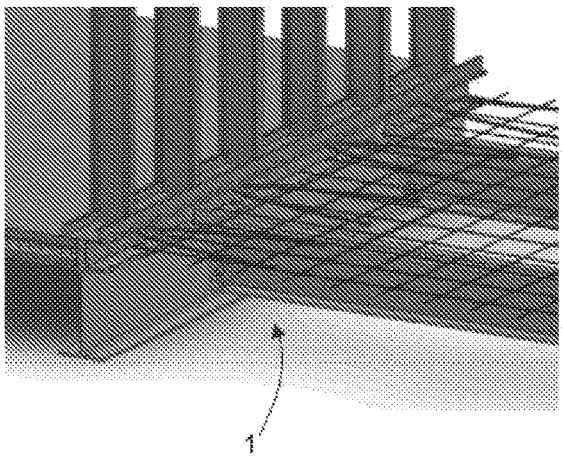
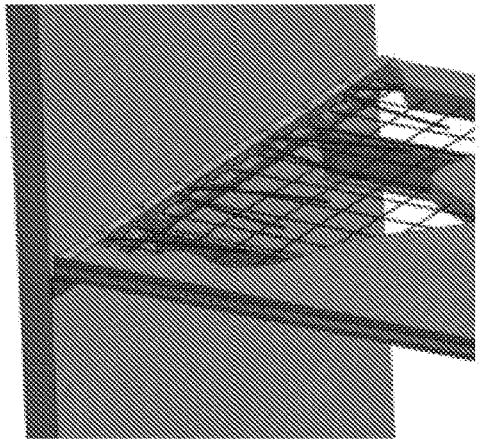
FIGURE 14
FIGURE 15
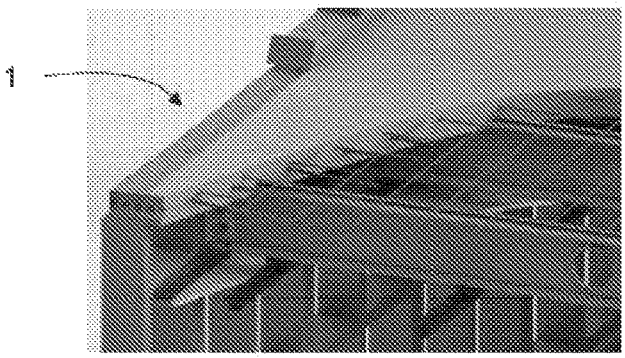

BUILDING PANEL

FIELD OF THE INVENTION

The present invention relates to a building panel and construction method therefor.

BACKGROUND TO THE INVENTION

The use of transportable pre-cast concrete slab panels utilising an assembly of metalwork, in particular steel joists in between steel end caps are known in the art. These precast panels typically utilise a periphery of metal formwork. An example of product is the "transportable concrete floor" manufactured by New Zealand company SPEEDFLOOR. Current panels may be heavy, difficult to manoeuvre once set, require extensive formwork, and/or may be difficult to remove from formwork.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

It is an object of the present invention to provide a building panel which overcomes or at least ameliorates some of the abovementioned disadvantages or which at least provides the public with a useful choice.

Other objects of the invention may become apparent from the following description which is given by way of example only.

SUMMARY OF THE INVENTION

According to a first aspect the invention broadly comprises a building panel to be supported, the building panel comprising

- two spaced apart elongate metal C-shaped end caps parallel each other, each end cap having a top and bottom flange, and a side wall opposite an opening and intermediate the top and bottom flange, each end cap comprising at least one pair of coaxial holes located on the top flange and bottom flange,
- at least one metal joist spanning between the two end caps,
- at least two hangers, one hanger intermediate each end of the joist and the respective end cap, to couple the joist to the end caps, each hanger comprising,
- a passage-defining hanger member engaged between said at least one pair of coaxial holes, the hanger member defining a passage intermediate the top flange and bottom flange, and
- a hanger flange extending off the hanger member and engaged with the joist, and
- a slab cast about a portion of the joist, hanger member, portion of the hanger flange, and cast through the openings of end caps that face each other.

In one embodiment, at least one passage-defining member engages with the at least one pair of coaxial holes to form a conduit through the slab between the top and bottom flange.

In one embodiment, the passage-defining member is the hanger member, or is a different passage-defining member, such as a mounting member.

In one embodiment, one or more of the hanger member, passage-defining member, and mounting member is a tube.

In one embodiment, the slab is composed of set concrete and has a top face, a bottom face opposite and generally parallel the top face, and two side walls intermediate the end caps.

In one embodiment, the at least one side wall comprises an indent that is configured to act as a shear key, when filled with set grout, when the sides of adjacent panels are adjacent each other in operation.

In one embodiment, the side wall comprises a channel and protrusions extending into the channel.

In one embodiment, the side wall comprises a channel comprising protrusion extending into the channel, where the channel and protrusions are configured to resist movement in at least three orthogonal directions when the channel is filled with a rigid material (i.e. grout) and is located directly adjacent a like side wall of a like panel.

In one embodiment, the indent is an elongate channel in the direction of the side, and/or the elongate channel is triangular shaped in cross section.

In one embodiment, the channel comprises protrusions extending in a direction generally away from the interior of the panel.

In one embodiment, the channel comprises protrusions extending in a direction on a plane parallel the plane of the slab.

In one embodiment, the side wall comprises an upper face, towards the top face and a lower face towards the bottom face, the upper and lower faces being generally orthogonal to the top face.

In one embodiment, the channel and protrusions are generally intermediate the upper and lower face.

In one embodiment, the hanger tubes and/or mounting tubes provide mounting points, for engagement with one or more of

- a lifting eye,
- a through bolt,
- a screwed connection, and
- removable features.

In one embodiment, the mounting members are cast with or welded to the end cap.

In one embodiment, the end cap comprise recesses at each end of either or both of the mounting member and hanger member, to allow fasteners to sit flush with the top and/or bottom flange outer facing surfaces.

In one embodiment, the fasteners are bolts or screws.

In one embodiment, the hanger tube engages with the end cap via an annular shoulder present on the hanger tube, the inserts at least partially within one of the coaxial holes.

In one embodiment, the hanger member is configured to snap fit with the end cap.

In one embodiment, the hanger member is configured to snap fit with the co axial holes.

In one embodiment, the top flange and bottom flange have surfaces that face each other.

In one embodiment, the hanger tubes have a length equal to the distance between the surfaces that face each other.

In one embodiment, the hanger tubes have a length greater than the distance between the surfaces that face each other.

In one embodiment, the hanger member can rotate relative to the end cap.

In one embodiment, the hanger flange is removably coupled to the joist.

In one embodiment, the hanger flange is engaged to the joist by fasteners, for example the fastener is a bolted connection.

In one embodiment, rebar is threaded about the mounting tubes and/or hanger tubes.

In one embodiment, the panel comprises no lateral edging intermediate the end caps.

In one embodiment, the end caps are configured to be supported below by a building structure, or from above by a building structure.

In one embodiment, the panel can be lifted via a connection directly or indirectly to the mounting and/or hanger members.

In one embodiment, the slab depth is generally the same depth as an end cap.

In one embodiment, the joist depth is greater than the slab depth.

In one embodiment, the hanger flange extends outside the opening, and past the bottom flange.

In one embodiment, a portion of the joist is below the bottom flange.

In one embodiment, a portion of the joist is not set in the slab.

In one embodiment, the portion of the joist not set in the slab extends along the majority of the length of the slab.

In a further aspect the present invention relates to a kit of parts for forming an assembly for a building panel, the kit of parts comprising two elongate metal C-shaped end caps opposite and parallel each other, each end cap having a top and bottom flange, and a side wall opposite an opening and intermediate the top and bottom flange, each end cap comprising at least one pair of coaxial holes located on the top flange and bottom flange, at least one metal joist, and two hangers, each hanger comprising; a passage-defining hanger member configured to engage with said two coaxial holes, the tube; and a hanger flange extending off the hanger member and configured to engage with the joist.

In one embodiment, the kit of parts comprises formwork configured to extend between the end caps.

In one embodiment, the assembly is configured to contain a settable material defined by a periphery created when the end caps and formwork are arranged in a polygonal shape.

In one embodiment, the kit of parts comprises fasteners for coupling the joist to hangers.

In one embodiment, the kit of parts comprises rebar, to be set within the settable material.

In one embodiment, the kit of parts comprises lifting fasteners configured to engage with the hanger member.

In one embodiment, the kit of parts comprises a flexible mould configured to couple with the formwork so in use, the mould forms a channel with protrusions along the side of the set settable material.

In a further aspect the present invention relates to a method of constructing a building panel, the method comprising the steps of providing a kit of parts as described above, aligning two end caps parallel and opposite each other engaging the hangers to the joist, and coupling the hangers to the end caps.

In one embodiment, the coupling of the hangers to the end caps further comprises the step of coupling the hanger tube rotatably to the coaxial holes.

In one embodiment, the end caps are placed on supporting surface upside down, compared to their in-use orientation.

In one embodiment, the end caps comprise at least one mounting tube engaged between, and to, the top and bottom flange, to define a conduit between two coaxial holes located, coaxially with the conduit, and in the top flange and bottom flange.

In one embodiment, the method further comprises the step of threading rebar about the at least one mounting tube.

In one embodiment, the method further comprises the step of arranging formwork in-between the ends of the end caps, so the formwork and end caps together form a rectangular closed shape.

In one embodiment, the method includes the step of forming a shear key indentation at a side of the panel with a mould formed into, or engaged with the formwork.

In one embodiment, the mould is flexible.

In one embodiment, the method comprises the step of pouring a settable slurry, such as concrete, into the periphery.

In one embodiment, the method comprises the step of removing the formwork.

In one embodiment, the method comprises the step of removing the mould from the side of the slab formed from the cured settable material.

In one embodiment, the method comprises the step of lifting the panel via the hanger tubes and/or mounting tubes.

In a further aspect the invention comprises a structure comprising two or more building panels as claimed in claim 1, wherein at two panels are laterally adjacent each other, and the structure comprises a shear key formed by grout set within a gap formed by indents on the side of each panel, where the indents on each side of a panel are formed from the side of the panel comprising a channel with protrusions extending into the channel.

In one embodiment, the shear key resists movement between adjacent panels in at least three directions orthogonal to each other.

In one embodiment, the channel of one panel extends into the said panel and away from the adjacent panel, and wherein the protrusions of one panel extend out of the said panel and towards the adjacent panel.

In one embodiment, at two panels are laterally adjacent each other, and the structure comprises a shear key formed by grout set within a gap formed by indents on the side of each panel, where the indents on each side of a panel are formed from the side of the panel comprising a channel with protrusions extending into the channel.

In one embodiment, the shear key resists movement between adjacent panels in at least three directions orthogonal to each other.

In one embodiment, the channel of one panel extends into the said panel and away from the adjacent panel, and wherein the protrusions of one panel extend out of the said panel and towards the adjacent panel.

In a further aspect the present invention relates to a hanger for a joist, the hanger comprising;

an elongate member comprising a top region and a bottom region, the member defining a passage extending between the top and bottom region, the top and bottom regions configured to engage with edges of an upper and lower circular hole respectively, where the holes are coaxial to with other and the passage; and a flange extending radially out from the member, and also extending past the bottom region of tube in a direction away from the top region.

In one embodiment, the member is a tube.

In one embodiment, the tube is an annular tube, rectangular tube, polygon tube, or other shaped tube.

In one embodiment, the top region and bottom region comprise an annular step configured to engage with the edge of said holes.

In one embodiment, the tube is configured to rotate about the coaxial axis of the holes.

In one embodiment, the hanger is composed of metal.

In one embodiment, the hanger is engaged to the joist via mechanical fasteners.

In one embodiment, the flange is configured to engage with the joist via a bolted connection.

In a further aspect the present invention relates to a male mould for moulding a channel into the side of a building panel formed partially from a settable material, wherein the mould is an elongate flexible plastic moulded strip that comprises magnets integrated along the length of the mould.

In one embodiment, the magnets are nearest a back non-moulding surface of the mould.

In one embodiment, the moulding surface of the mould comprises a raised elongate section configured to form a channel in the side of the panel, and one or more recesses configured to form protrusions extending into the channel.

In a further aspect the present invention relates to a two piece mould for forming a contour into a settable material, the mould comprising

- an elongate flexible strip profiled to create a desired contour into settable material,
- an elongate rigid backing member configured to removably engage with, and support, the strip.

In one embodiment, the engagement between the member and strip is a magnetic engagement.

In one embodiment, the strip comprises imbedded magnets, and the member is or comprises ferrous material(s).

In one embodiment, the member comprises magnets, and the strip comprises imbedded ferrous materials.

In one embodiment, the member is a formwork that is configured aid in retention of said settable material.

In one embodiment, the strip has a rear surface that is planar and a front surface or surfaces that from the profile.

In one embodiment, the rear surface is configured to abut against the member when engaged.

In one embodiment, strip profile comprises a cross sectional shape that comprises both a protrusion that protrudes away from the member in use, and an indent that extends into the protrusion towards the member in use.

In one embodiment, the strip profile forms a contour that when formed into a set settable material and filed with grout, the grout mechanically locks with the profile in at least two directions.

In one embodiment, the grout mechanically locks with the profile in at least three directions.

In one embodiment, the grout adheres with the profile in at least one direction.

In one embodiment, the contour is contoured so it as able to be released from the settable material after the settable material is set.

In a further aspect the present invention relates to a mould for forming a contour into a settable material, the mould having a body comprising

- a substantially planar non-moulding back surface,
- a moulding surface that comprises both a protrusion that protrudes in a first direction away from the back surface, and an indent that extends into the protrusion towards the back surface.

In one embodiment, the indent comprises at least one surface that at least a portion of is generally orthogonal, or at least not parallel, to the back surface.

In one embodiment, at least one surface is defined in-between an outer protrusion surface that is defined on the protrusion and inner indentation surface that is defined in the indent, the at least one surface generally orthogonal, or at least not parallel, to the back surface.

In one embodiment, the at least one surface is two surfaces generally facing each other and/or orthogonal, or at least not parallel, to back surface.

In one embodiment, the two surfaces are one continuous surface, which faces itself.

In one embodiment, the continuous surface, or at least one surface, is tapered inwards towards the back surface.

In one embodiment, the protrusion has a constant cross-section along the length of the body, excluding where there is an indent.

In one embodiment, the indent substantially shorter than the protrusion.

In one embodiment, the indent is located at least partially at the apex of the protrusion.

In one embodiment, the protrusion is triangular shaped in cross section.

In one embodiment, the indent is chevron shaped in side view when facing the protrusion.

In one embodiment, the indent asymmetrical or symmetrical.

In one embodiment, there are multiple indents along the length of the body.

In one embodiment, the multiple indents are shaped differently to each other.

In one embodiment, the indent is configured to be shaped like a letter of a word.

In one embodiment, the indents are configured to spell a word or name.

In one embodiment, the indent does not extend past the plane of the top surface.

In one embodiment, the mould body has a periphery defined by two ends in the elongate direction, two edges, and two sides, wherein the sides comprise the moulding surface and back surface.

In one embodiment, the indent is located intermediate the two edges.

In one embodiment, the mould body is thicker at one edge, compared to its opposite edge, for in use forming a channel in the settable material for allowing grout to enter the channel formed by the contour of the mould.

In one embodiment, the body comprises a planar surface, that is formed as part of the moulding surfaces, that is generally parallel the back surface.

In one embodiment, the mould is an elongate flexible strip.

In one embodiment, the strip comprises imbedded magnets or imbedded ferrous materials.

In one embodiment, the mould is configured to mould an impression into a settable material.

In one embodiment, the mould is configured to mould an impression into the side of a concrete panel.

In one embodiment, the impression is configured to be filled with grout.

In one embodiment, the grout is configured to engage with the impression in at least three orthogonal directions.

In one embodiment, the grout is configured to engage mechanically with the impression in at least two orthogonal directions, and engage by adherence on one direction orthogonal to the at least two mechanical orthogonal directions.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

The term "hanger" as used in this specification and claims means generally hanger or 'shoe' that is configured to allow a joist/beam to be engaged or be supported by another building feature.

The term "joist" as used in this specification and claims means generally an elongate member configured to bear a load and span a width. The terms Joist and Beam can be interchangeable.

The term "tube" as used in this specification and claims means generally an elongate member defining an internal conduit. It is envisaged that a tube can be a hollow elongate member of any internal and/or external cross sectional shape.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention will now be described by way of example only and with reference to the drawings in which:

FIG. 11 shows a cross sectional end view of two adjacent panels highlighting the indent and the gap formed between.

FIG. 12 shows a bottom perspective view of a panel installed between steel columns, with the slab cutaway for clarity, and a ceiling installed below the joist.

FIG. 13 says a top perspective view of an assembly with an end cap is being supported by a beam.

FIG. 14 shows a top perspective view of a panel being supported by a flange connected to a concrete wall.

FIG. 15 shows a top perspective view with a panel being supported by a timber framing, with the slab cutaway for clarity.

DETAILED DESCRIPTION OF THE INVENTION

Figure 1:
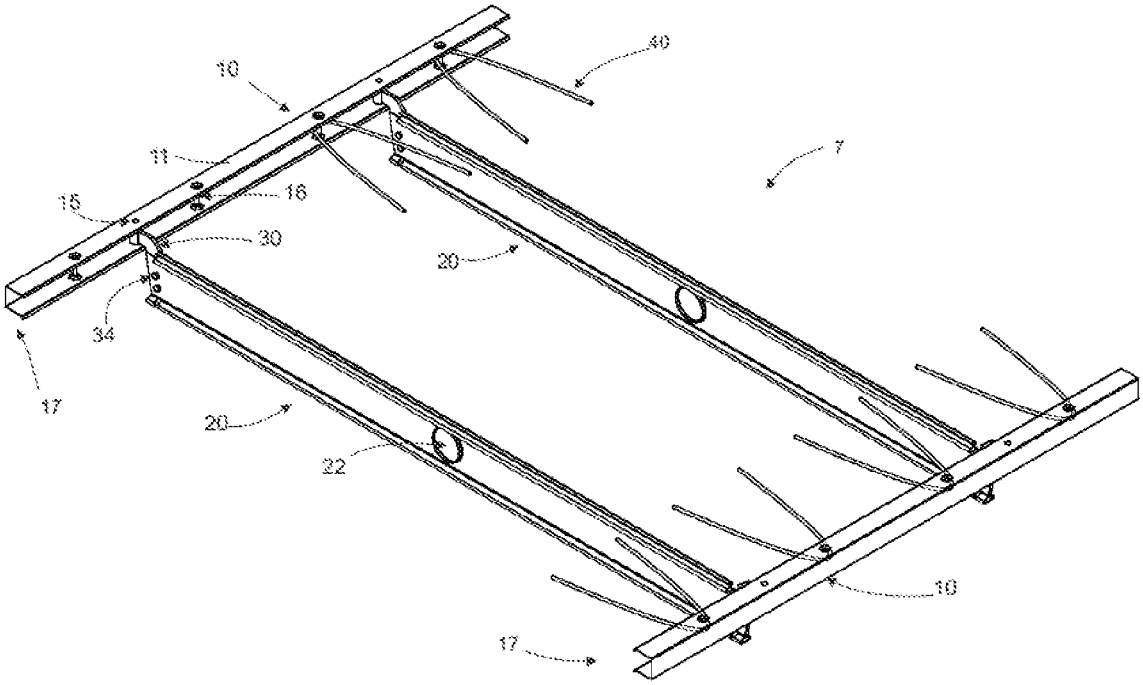
FIG. 1 shows a top perspective of an assembly for a panel.
Figure 2:
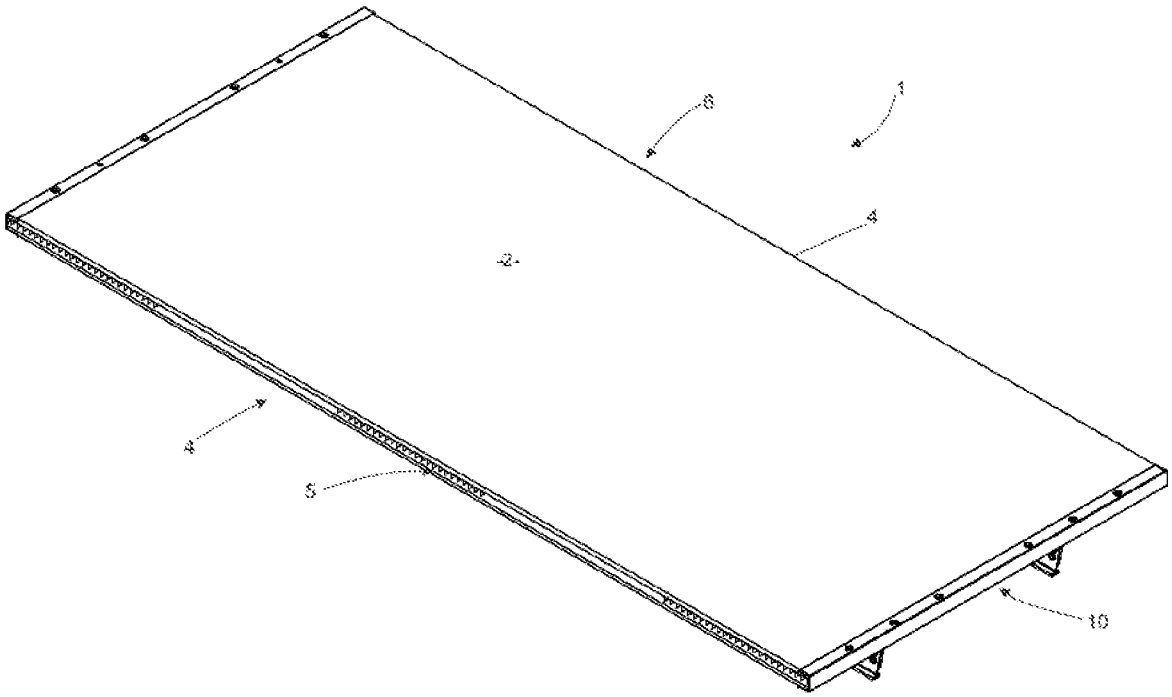
FIG. 2 shows a top perspective of a panel.
Figure 3:
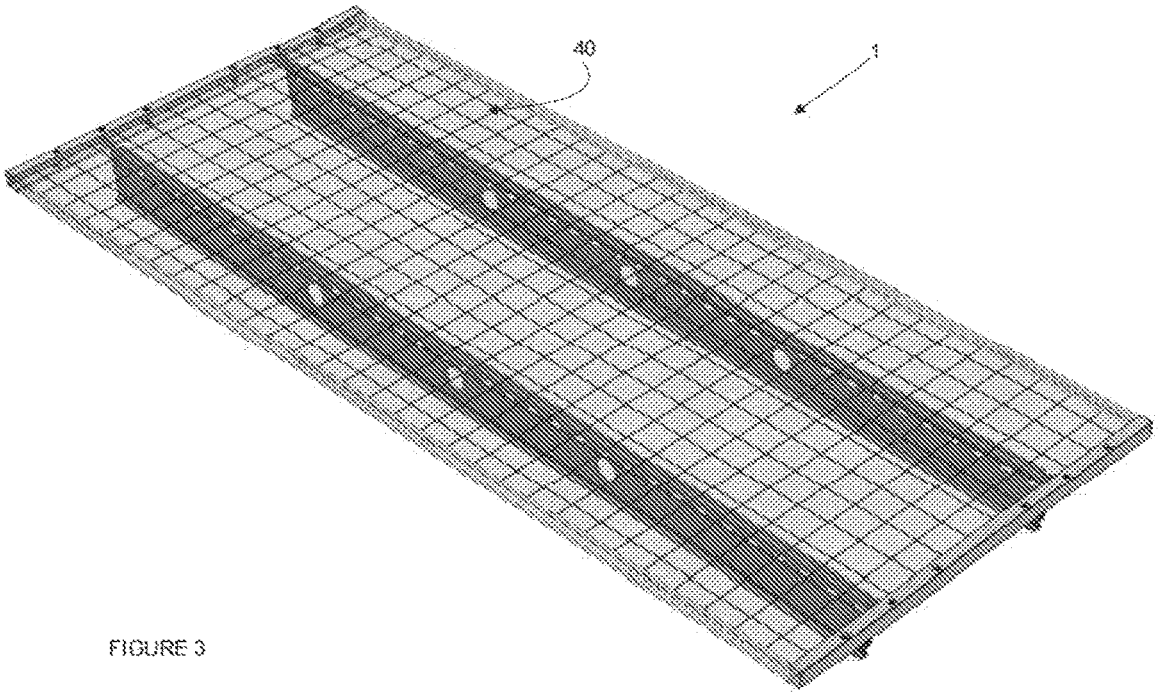
FIG. 3 shows a top perspective of a panel, with the slab transparent for clarity.
Figure 4:
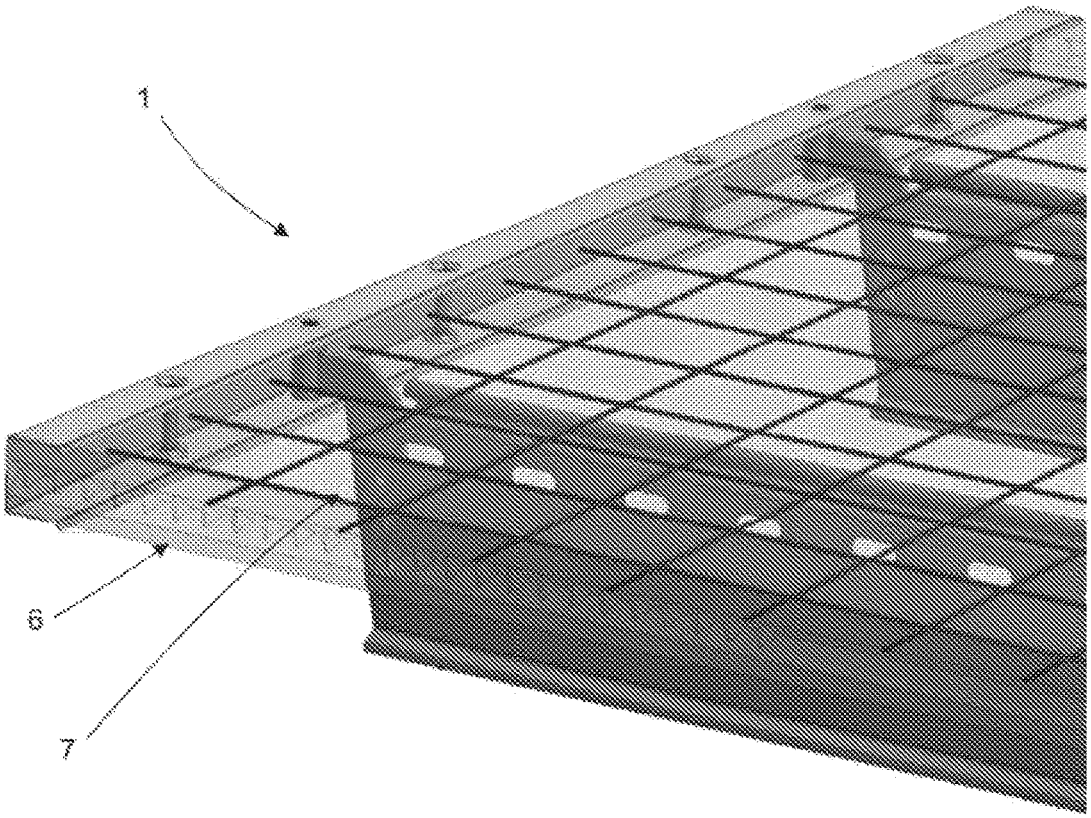
FIG. 4 shows a top perspective side view of a corner of a panel with the slab transparent.

The present invention is a precast or cast on site panel that is preferably configured for use above the ground or as a 'mid-panel' 1. A mid-panel is a panel that can be used as an above ground level floor, and also a ceiling to the below floor. The panel 1 is comprised of an assembly 7 and a slab 6 formed about parts of the assembly 7.

The assembly 7 comprises two end caps (also known as bulk heads) 10 facing each other, spanned between them is a joist 20, preferably two joists 20. The panel 1 is formed with a concrete or like settable slurry forming a slab 6 set in between the two end caps 10 and partially around the joist 20.

The end caps 10 are laid upside down on a supporting surface. The supporting surface may have a liner of some sort. Formwork 50 is spanned in between each end 17 of the end cap 10. The formwork may be preinstalled, and the assembly 7 installed between the formwork 50, or the formwork 50 may be installed about the assembly 7. The formwork 50 is configured to retain the un-cured slab 6 within the periphery formed by the end caps 10 and the formwork 50.

The joists 20 intermediate the end caps are engaged to the end caps via a hanger 30. There is a hanger 30 between each end of the joist 20 and each end cap 10. The hangers 30 are engaged to the end caps 10 and the joists 20 are subsequently engaged to the hangers 30. The end caps 10 are now engaged to each other, via the joists 20 via the hangers 30. The slurry is poured into the periphery formed by the end caps 10 and formwork 50, so as to fill at least up to the depth of the end caps 10.

In a preferred embodiment, only a portion of the joists, the first portion 23, is set in the slurry whilst the remaining portion 24 of the joist 20 is exposed from the slurry. The first portion 23 is designed and configured to a large surface area and extend in multiple directions so as to have a good lock or engagement with the slab 6.

Once the slurry is set, or at least partially set, the formwork 50 can be removed and the panel 1 can be located to a desired location. Before it is installed, the panel 1 will need to be inverted (from an orientation at where it was set) so that the exposed portions 24 of the joists 20 face downwards below a bottom face 3 of the slab 6. Before installation, the panel one can be stored with the joists facing up or down.

In some embodiments, the formwork 50 may be kept on the panel 1 whilst it is still curing. However, the panel 1 along with the formwork 50 may be removed from a supporting surface and located to a desired location.

In further embodiments, rebar 40 is inset into the slab 6 either as a grid laid out in the typical fashion amongst along most or the entire surface area of the slab 6.

In further embodiments, curved U-shaped rebar 40 may be extended around members of the end cap 10 and inset into the slab 6, to further engage the slab 6 with the end caps 10.

Figure 7A:
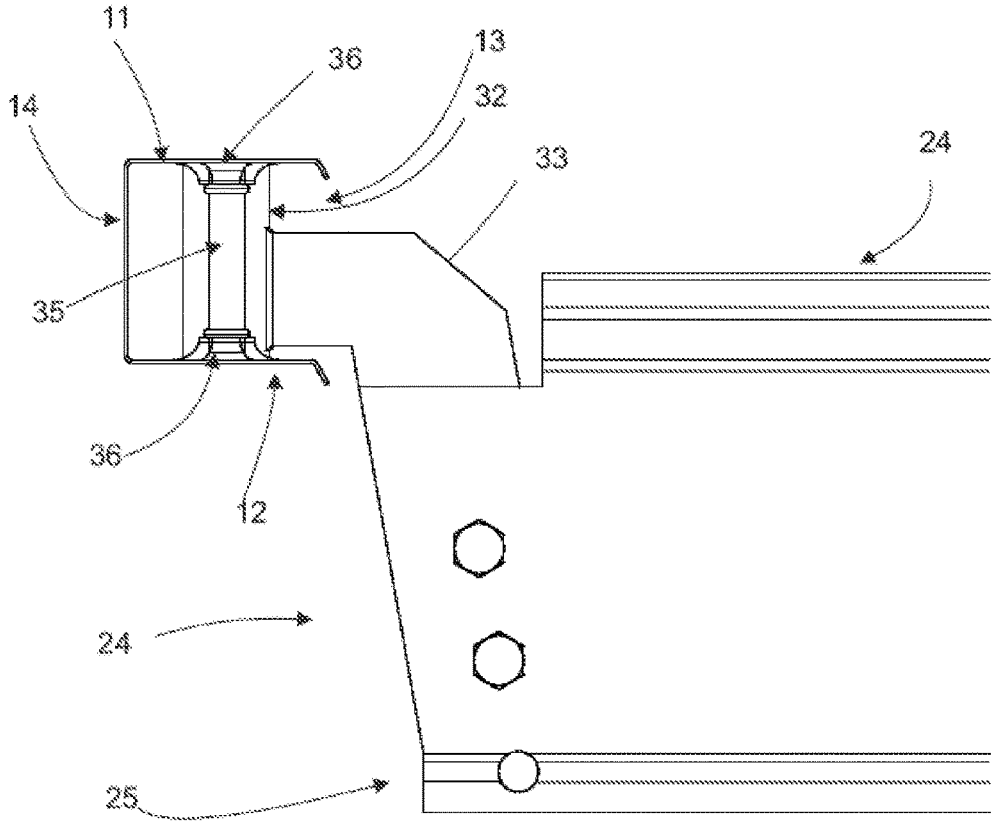
FIG. 7A shows a cross sectional side view of a hanger engaged to an end cap.
Figure 7B:
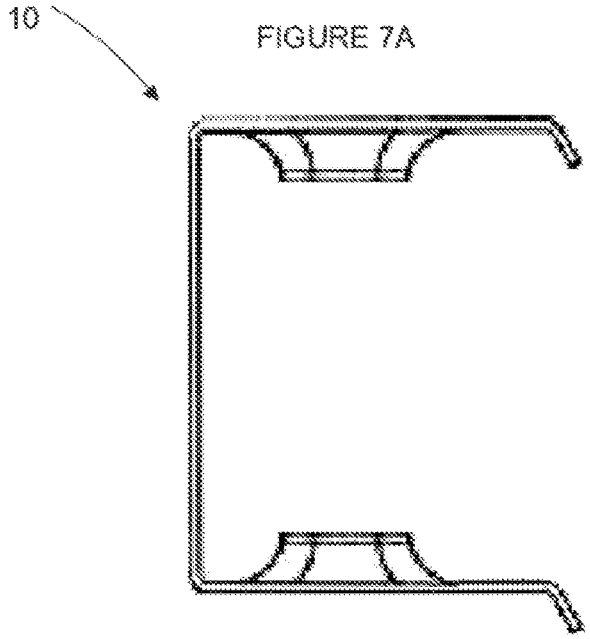
FIG. 7B shows a cross sectional side view of the end cap where the mounting tubes are to be engaged.

The end cap 10 is preferably a C-shaped channel as shown in cross section in FIG. 7B. The C-shaped channel having a top flange 11, a bottom flange 12, and spanning between the top flange 11 and bottom flange 12 is a side wall 14. The end cap comprising an opening 13, opposite the side wall 14 and opening towards the hangers 30 in use.

When two end caps 10 of a panel are facing each other, the openings 13 face 10 each other. Intermediate the top flange 11 and bottom flange 12 are preferably one or more selected from a) mounting member 16 and b) hanger member 32. The member preferably defines a passage or conduit. Preferably the member is a tube. The mounting tubes 16 are configured to allow the panel 1 to be mounted to a building 5, or building structure 5, and are configured to act as lifting points or anchors when lifting the panel 1, and/or allow the U-shaped rebar 40 to wrap about them. The hanger tube 32 is configured for the same purposes, but is formed as part of the joist hanger 30 instead of the end cap 10.

The hanger tube 30 is configured to engage with coaxial holes 15 that are formed and the top signed 11 and bottom plans 12 of the end cap 10. A through hole or conduit 35 is formed by the hanger tube 32 engaging with the co axial hole 15. As previously described, the conduit 35 can act as a mounting or lifting point.

Extending from the hanger tube 32 is a hanger flange 33. The hanger flange is configured to be engaged to the joist 20. In one embodiment the hanger tube 32 as relative to the hanger flames 33, in other embodiments it may be integrally formed or fastened in other typical manners.

The hanger flange 33 preferably comprises engagement fixtures 31. For example, bolt holes 31. The hanger 30 may be engaged to the joist 20 by a variety of engagement techniques and methods. Such methods or techniques include welding, riveting, mechanical locking tabs etc. In a preferred embodiment the hanger 30 is bolted to the joist 20 as shown in the figures. Preferably the means to fasten the hanger 32 to joist 20 is by a removable fastener.

Preferably the hanger 30 can rotate when first engaged with the hanger tube 32 of the end cap 10. This rotational aspect allows the joist 20 to more easily engage to the hangers 30.

Figure 5:
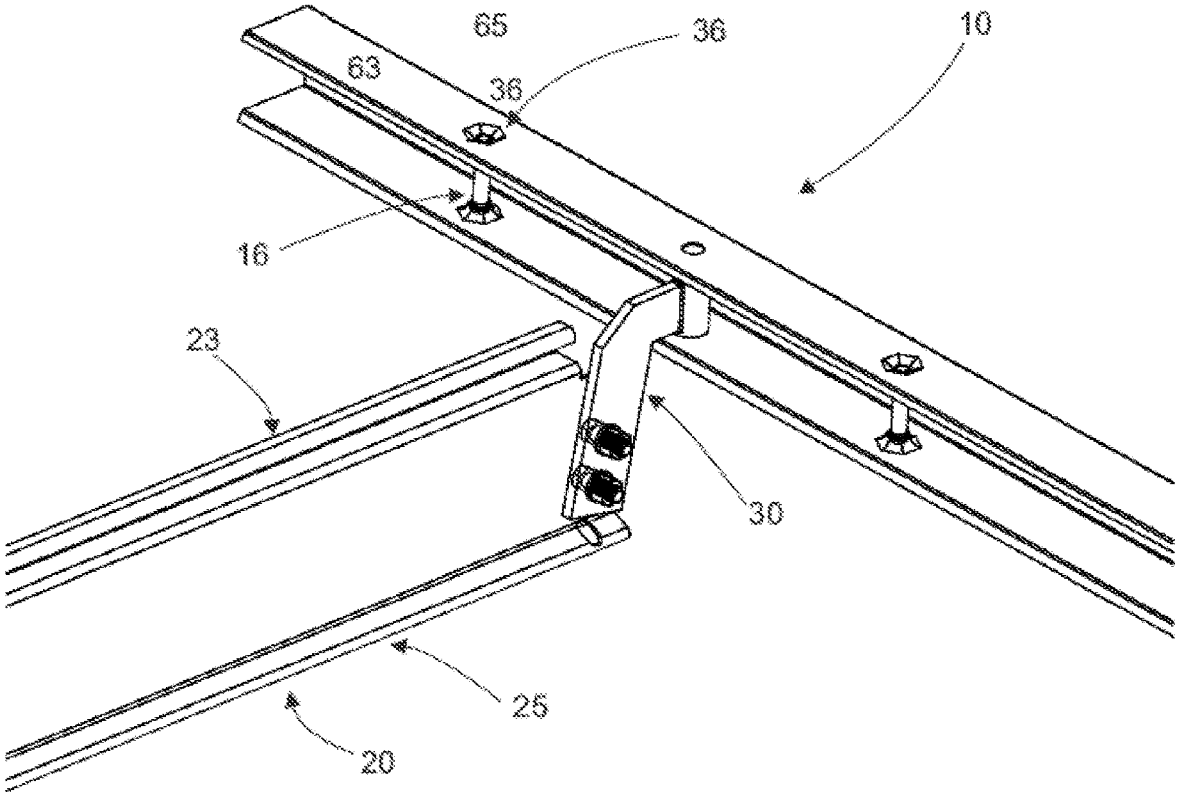
FIG. 5 shows a top perspective view of an end cap and hanger engaging a joist.

On the opposite side to the first portion 23 of the joist 20, is a stiffening 15 element 25. The stiffening element 25 is configured to stiffen the joist 20. The stiffening element 25 is shown in FIG. 5.

In use the end caps 10 can be engaged to and/or supported by a building 5. The end caps 10 can cooperate with a building structure in a variety of configurations. In one embodiment the end caps 10 have their bottom flange 12 rest upon a building structure 5 to support the panel 1. Engagement of the end cap to the supporting structure may also, separately or combined with said support, be through the hanger conduit 35 and/or the conduit is formed by the mounting tubes 16.

The end caps 10 may be supported along the entire length or at any region of their length. The end caps of the panel 1 may be suspended from a supporting structure via the conduits formed by the hanger tube(s) 32 or mounting tube(s) 16.

An important aspect of the present invention is that the panel 1 can have its weight supported through the hanger tube 32 that directly distribute the load through the hangers 30. This allows the panel 1 to be lifted in a distributed manner so that there are no concentrated forces on the slab 6 itself.

Lifting through the hanger tube 32 also allows the panel 1 to be removed from the supporting surface after casting earlier than typical, while the settable material, such as concrete, is not fully cured/set. This may be due to two reasons. The first is because the panel 1 is lifted via the hanger tubes 32 which support the slab 6 weight through the joists 20. For example, if the panel 1 was lifted by the end caps at the ends 17, there may be a twisting effect or there may be too much load going through the concrete 6 itself. The second reason is that the end caps 10 are supported by the supporting service, such as the ground, and it may be difficult to get under the end caps 10 to lift up the panel 1. With the utilisation of the mounting tubes 16 or hanger tubes 32, a lifting point can be created from the top of the end cap 10 (i.e. the bottom flange 12 because the panel is inverted). This allows the panel to be lifted up via the end caps 10 without needing to get under the panel 1.

The mounting tubes 16 or hanger tubes 32 can be mounting points for one or more of a lifting bolt, a screw connection or other removable features.

Preferably the mounting tubes 16 are welded and/or swaged to top flange 11 and bottom flange 12 to form a conduit therethrough along with the coaxial holes 15.

Preferably the mounting tubes 16 and top flange 11 and/or bottom plans 12 comprise an inset/recess formation 36 (as shown in FIG. 7A) to allow any boltheads (not shown) or mounting points to remain flush with the bottom flange and/or top flange of the end cap. This allows the end cap to sit flush with a supporting structure.

Figure 6:
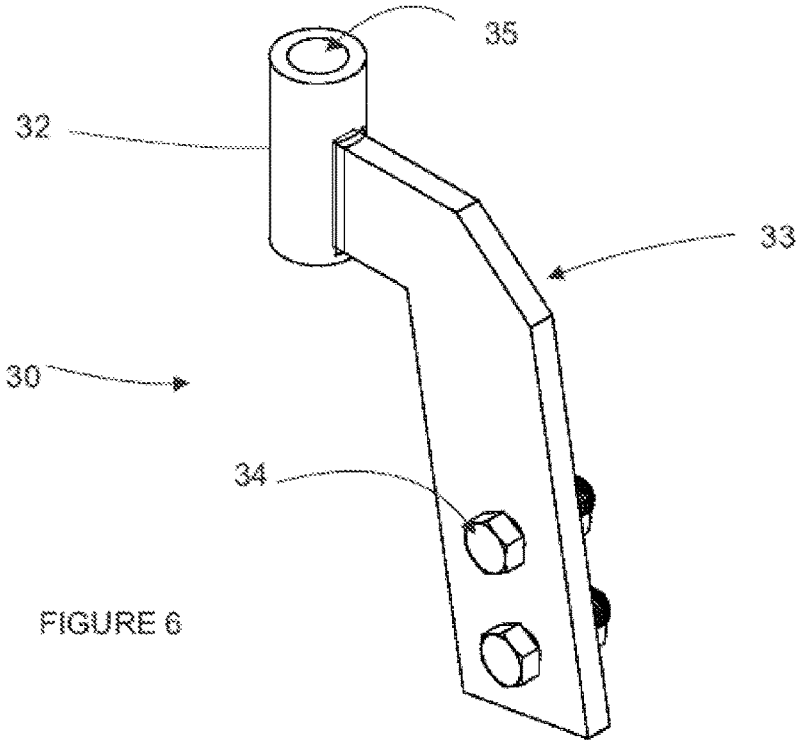
FIG. 6 shows a top perspective view of a hanger.
Figure 6A:
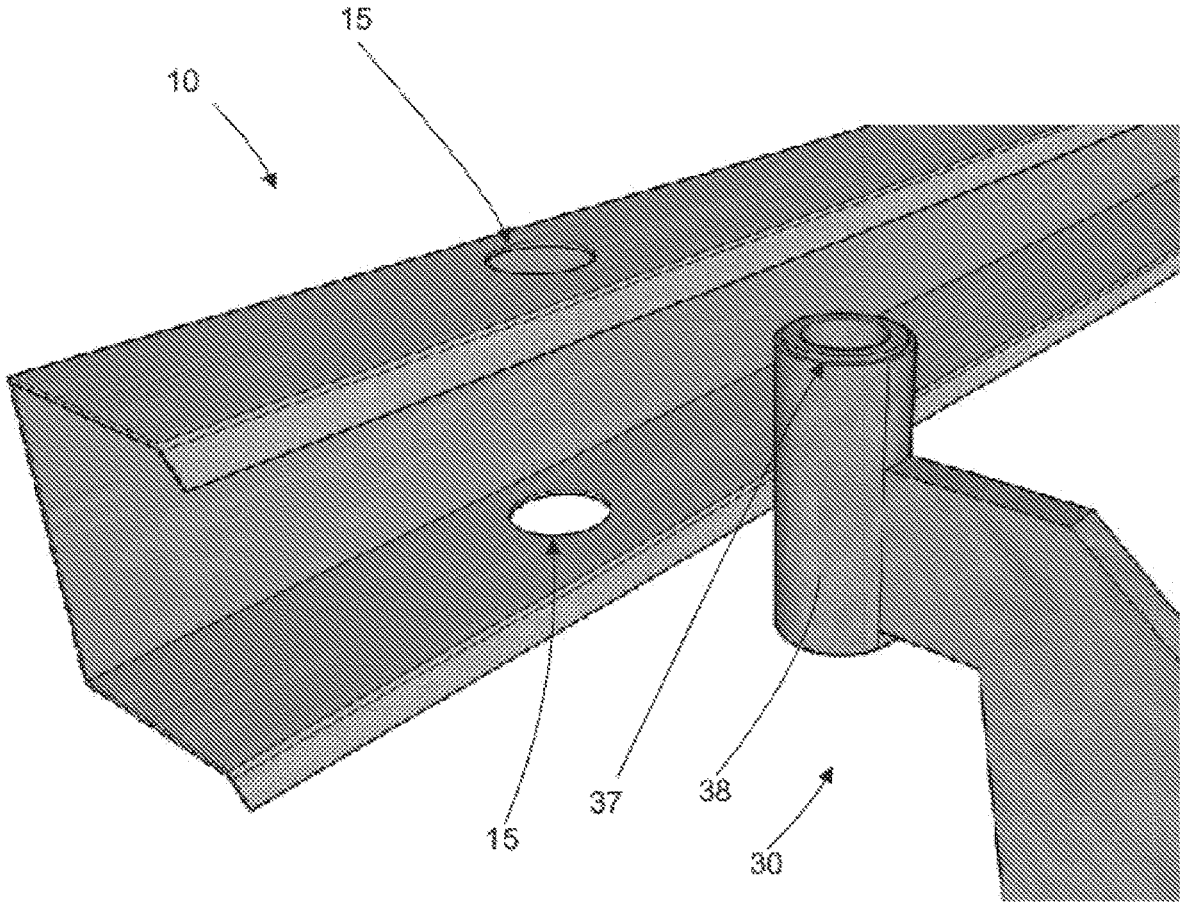
FIG. 6A shows a perspective view of a hanger being engaged to an end cap.

The hanger flange 33 preferably engages with the coaxial holes 15 on flanges 11 12 via shoulders 37 on the hanger tube 32 as shown in FIG. 6A.

The raised annular shoulder 37 is able to engage internally of the co axial holes 15. The body of tube 32 abuts against the flanges 11 12. The shoulder 37 and coaxial hole 15 engagement allows the hanger tubes 32 to rotate with respect to the end cap 10. The rotational ability allows a connection tolerance between the end cap 10 and the joist 20. The tolerance allows some error in alignment between a cap 10 and the joist 20. For example, if the joist 20 is not perpendicular with the end cap 10, is still able to be engaged easily with the other end cap 10, due to the ability for the joist 20 to engage with the end cap 10 at a non-perpendicular angle due to the rotational ability of the hanger. The rotational ability aids in construction of the assembly 7.

Preferably the co axial holes 15 are punched into the top and bottom flange 11, 12. However, it is envisaged the holes 15 could be created from other methods.

In some embodiments the co axial holes 15 are not holes, but are recesses in the flanges 11 12. The recesses are able to accommodate at least a portion of the depth of the shoulder 37. The recesses allow the tube 32 to rotate relative the end cap still, but do not form a conduit through. In this embodiment, the conduit 35 is not required. In this embodiment, the hanger 30 does not form part of a mounting or anchor point. The coaxial holes 15 and shoulder 37 could be one of a number of features that allow rotational engagement.

The hanger 30 allows the use of a shallow end cap 10, where shallow is the height of the side wall 14. If using other methods to attach the joist 20 to the end cap 10 a deeper connection will be required and therefore a larger end cap will be required. Using the joist hanger 30 of the present invention allows for a shallow end cap 10 to be used with a deeper joist 20. This allows for a shallow depth of settable material 6 to be used to form the concrete panel.

Formwork and Moulds

Another feature of the present invention is that the panel 1 does not have any peripheral side walls in use that are part of the assembly. I.e. side walls that span the periphery between the ends 17 of the caps 10. This reduces weight, complexity and cost of the panel 1.

During casting, the formwork 50 may also include methods and features to form a moulded indent into the sides 4 of the slab 6. This indent 66 can be located along the entire length of the sides 4 or only partially along the length, or inconsistently along the length. The moulded indent 66 is formed via complementary mould protrusion 76 on a body 71 of a mould 70 that may be integral with the formwork 50 or may be of a separate construction removable from the formwork 50.

In a preferred embodiment the mould 70 is removably engaged to the internal side of the formwork 50. A back surface 78 abuts the formwork 50 in use. The back surface 78 is general planar, and orthogonal the top surface 2.

In one embodiment the formwork 50 is composed of metal, and the mould 70 is composed of a rubber or plastics material. Preferably the mould 70 is flexible so that it can be removed from the sides of the slab 6 when the slab 6 is set or at least partially set. If the mould 70 is rigid it is more difficult to remove from the sides 4 of the set or partially set slab 6.

In one embodiment, the mould 70 comprises magnetic inserts 75 inserted, engaged, adhered or moulded within the mould 70. This allows the mould 60 to be removably engageable to the internal side of the metal formwork 50.

In one embodiment there are a row of magnets moulded into the flexible plastics mould 70.

The method of forming the indent 66 is as follows; the formwork 50 is located in between the end caps 10. As such, a rectangular periphery is formed by the end caps 10 and the formwork 50.

The mould 70 is applied to the internal sides of the formwork 50. In other embodiments the mould 70 is already engaged with the formwork 50.

Once the formwork has been set up, a suitable slurry can then be poured into the periphery formed by the end caps 10 and the formwork 50. This is assuming the assembly 7 has already been assembled.

Preferably the mould 70 forms an indent 66 that can be used to act as a shear lock, when filled with grout or other like substance, between adjacent panels 1. This is because in use the panels 1 would likely be located with the sides adjacent to one another. Intermediate adjacent sides 4 of panels 1, a grout can be inserted between. This grout would preferably fill the indent 66 to create a shear lock or key or extra engagement between the sides 4 of adjacent panels 1.

Figure 8:
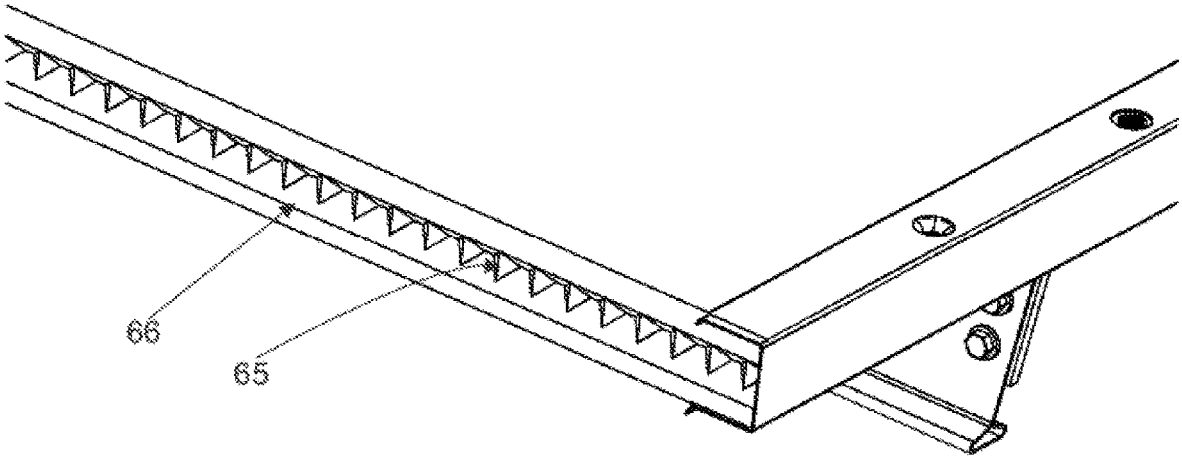
FIG. 8 shows a top perspective side view of a panel highlighting the indent.
Figure 9:
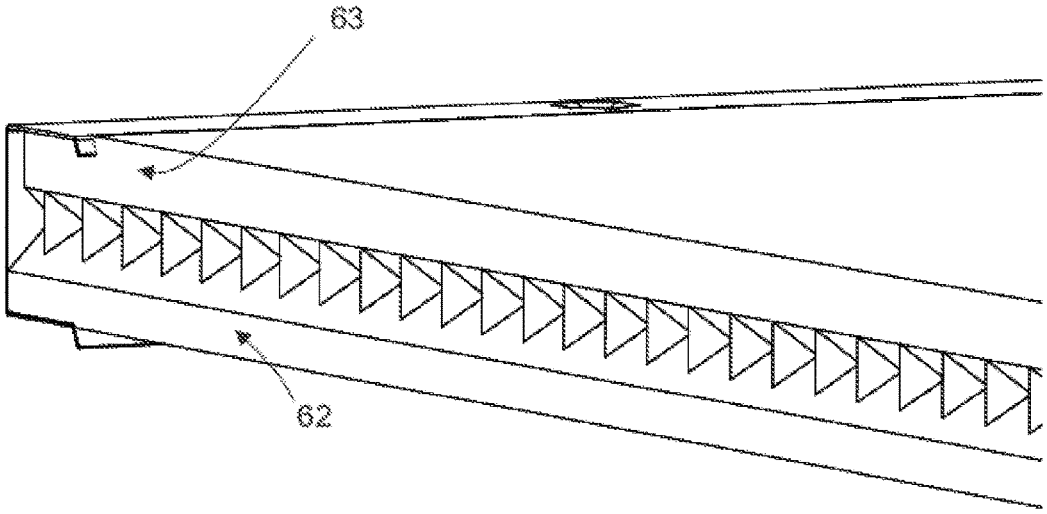
FIG. 9 shows a side view of the upper and lower face of the side of a slab.
Figure 10:
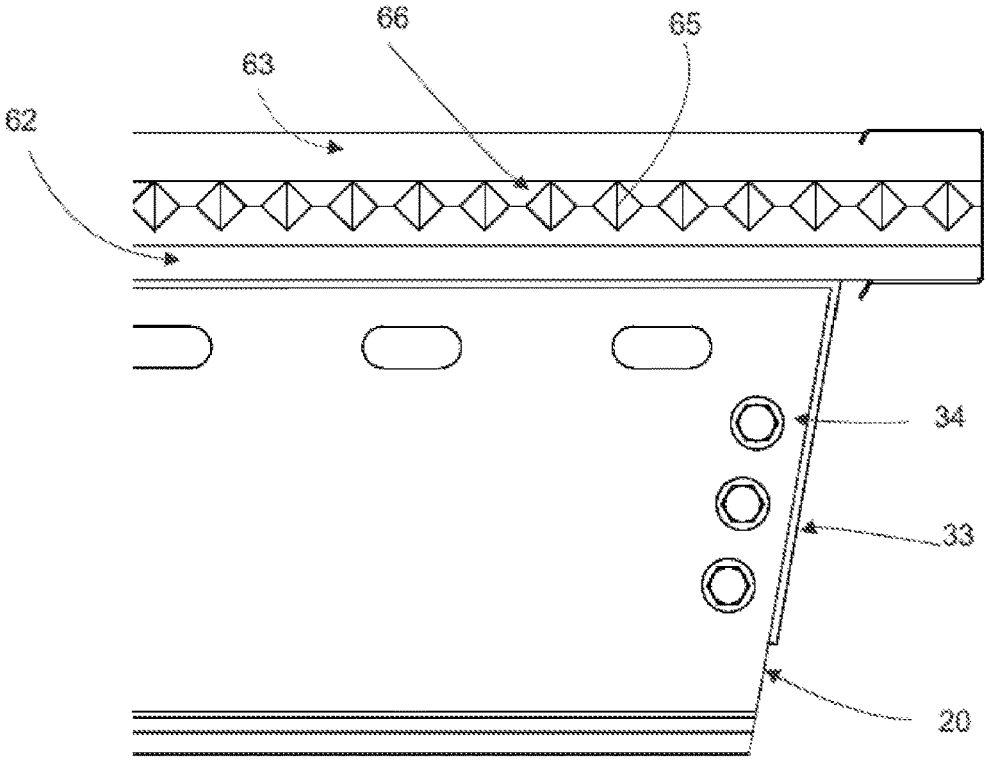
FIG. 10 shows a side view of an end portion of a panel.

The grout, not shown, will then be able to be inserted through an upper gap 64 formed between the sides of adjacent panels to enter into the indent 66 but not extend any further through the bottom faces 3 of adjacent panels 1. The indent 66 is shown in FIGS. 8 & 9.

Due to the shape of the mould 70, the sides 4 of a panel are not co-planar. A side 4 comprises two faces, one nearest the bottom face 3 and one nearest the top face 2. Preferably the sides 4 have a lower face 62 and an upper face 63. The lower face 62 and upper face 63 are not co-planar with each other. Preferably the upper face 63 is more inset than the lower face 62.

Preferably the lower faces 63 of adjacent panels 1 are able to abut one another, or at least be close enough so as to not allow grout to seep through.

The upper faces 63 are preferably more inset than the lower faces 63, and will form the gap 64 between adjacent sides 4.

Figure 11:
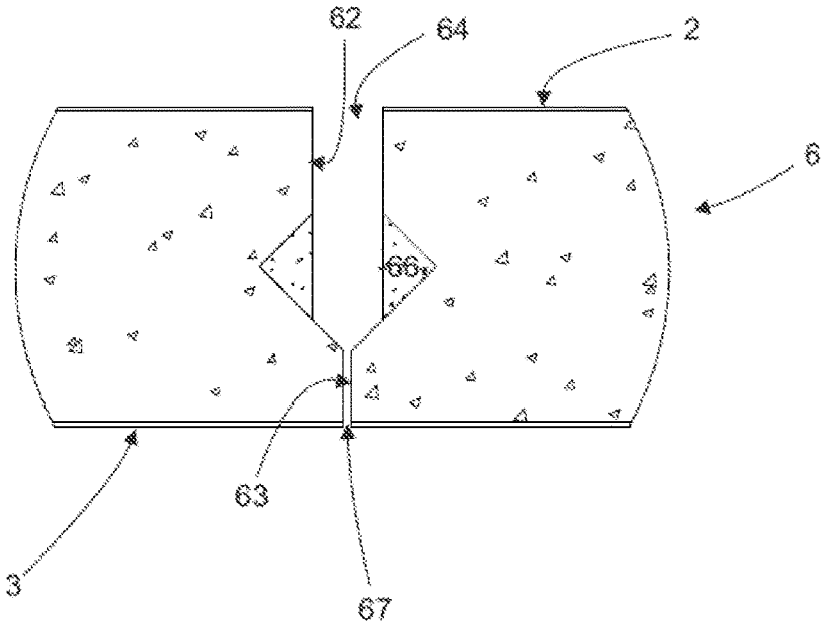

Preferably intermediate the upper face 63 and lower face 62 of a side 4 the indent 66 extends further into the slab 6. This is shown in FIG. 11 where the indent is a triangular formation facing into the slab 6.

The indent 66 may also have multiple protrusions 65 that extend outwards from the indent towards the planes of the upper and lower faces 62.

The indent 66 of the panel is formed by a complementary protrusion 76 on the mould 70. Likewise, the protrusion 65 of the panel is formed by a complementary indent 76 on the mould.

The indent 66 increases the engagement between panels. The indent 66 reduces movement or increases resistance to movement in the up and down direction towards the top face 2 and bottom face 3 of the panel 1. The indent 66 formed by the protrusion 76 forms surfaces or walls 61 that face the shear direction between adjacent panels, or at least are not parallel with the shear direction. I.e they may be orthogonal, obtuse or acute with shear direction, so to at least resist in use, in movement in the shear direction.

The surface(s) may be formed by orthogonal surfaces 74 on the mould. These walls 61 reduce or act against movement in the shear direction when the channel is filled with grout. In one embodiment, the surfaces 74 are one continuous surface 74. Preferably the surfaces 74 are tapered inwards towards the back surface of the mould to aid in release of the mould from the settable material.

The walls 61/indents 66 (when filled with grout engaged to a like panel) reduce movement and/or increase resistance to movement in the direction along the sides 4, i.e. shear forces/action between adjacent panels 1.

The protrusions 65 and indent 66 increase the surface area of the grout contacting the slab 6. This increased surface area increases engagement between panels to prevent them from separating away from one another.

Therefore the protrusions 55 and indent 66 is able to reduce movement, and/or increase resistance to movement in three dimensions. The resistance to movement may be due to a mechanical/physical locking. The resistance to movement may be due to chemical or adherence of the grout with the panel. It may be a combination of both, such as mechanical locking in two directions, and adherence in a third direction.

Preferably the indent 66 forms an upper gap 64 between the top faces 2 of adjacent panels 1 as shown in FIG. 11. This upper gap 64 allows the grout to be easily inserted into the indent 66.

In one embodiment the bottom face 3 between adjacent panels at the sides are abutting, are at the close enough to bring grout from running through adjacent panels. A slight gap 67 is shown in FIG. 11 highlighting this.

There may be a plurality of ways that an indent may be shaped and configured to achieve these functions. The functions being increased resistance to movement in all three directions. One example is shown in the figures where a simple triangular indent is formed with multiple three-dimensional protrusions within and along that indent. The indent 66 comprising a longitudinal triangular channel along a side 4 of a slab 6. In other embodiments, for example, a brand name may be moulded along the length of the side of a panel 1. The brand name may be moulded on a side 4, forming an impressed/stamped name or feature.

Figure 16:
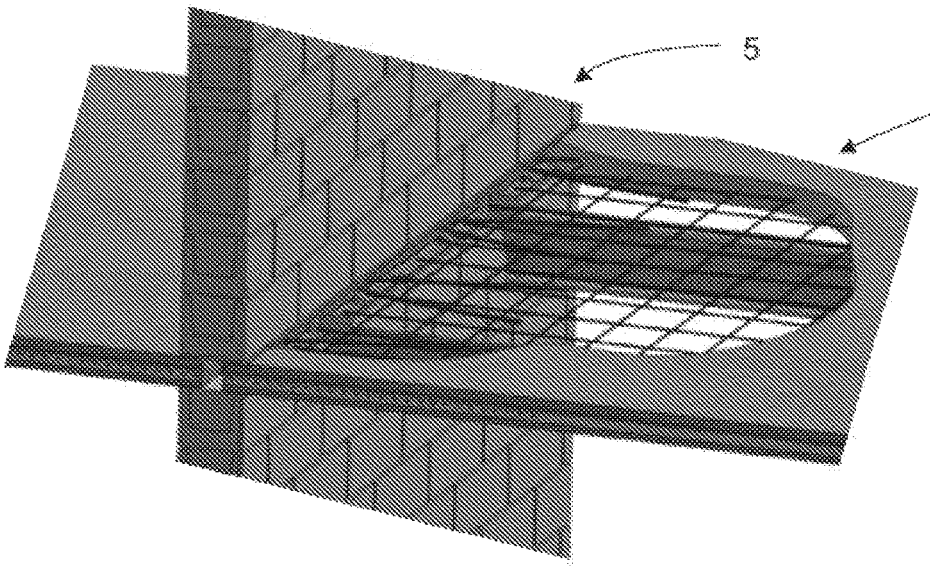
FIG. 16 shows a top perspective view with a panel being supported by concrete blocks, with the slab cutaway for clarity.
Figure 17:
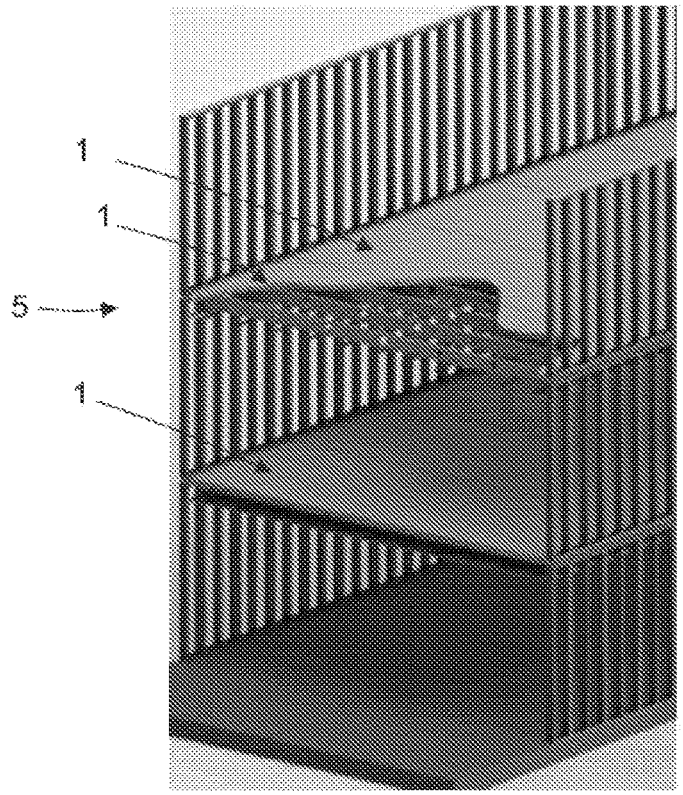
FIG. 17 shows a top perspective view of a building comprising multiple panels.
Figure 18:
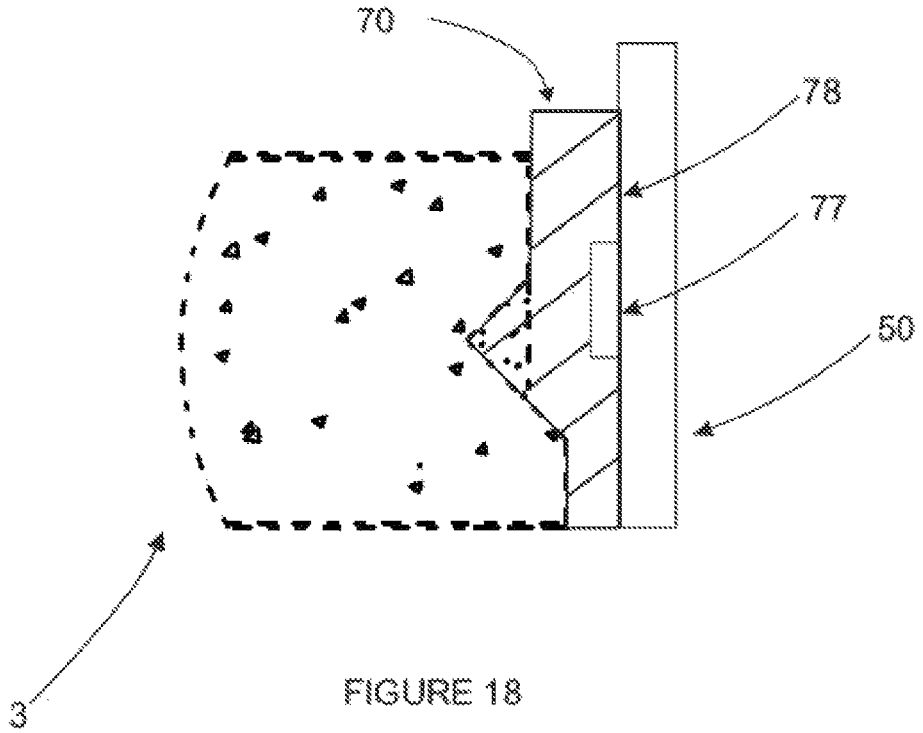
FIG. 18 shows a side cross sectional view of mould and related side of a panel.
Figure 19:
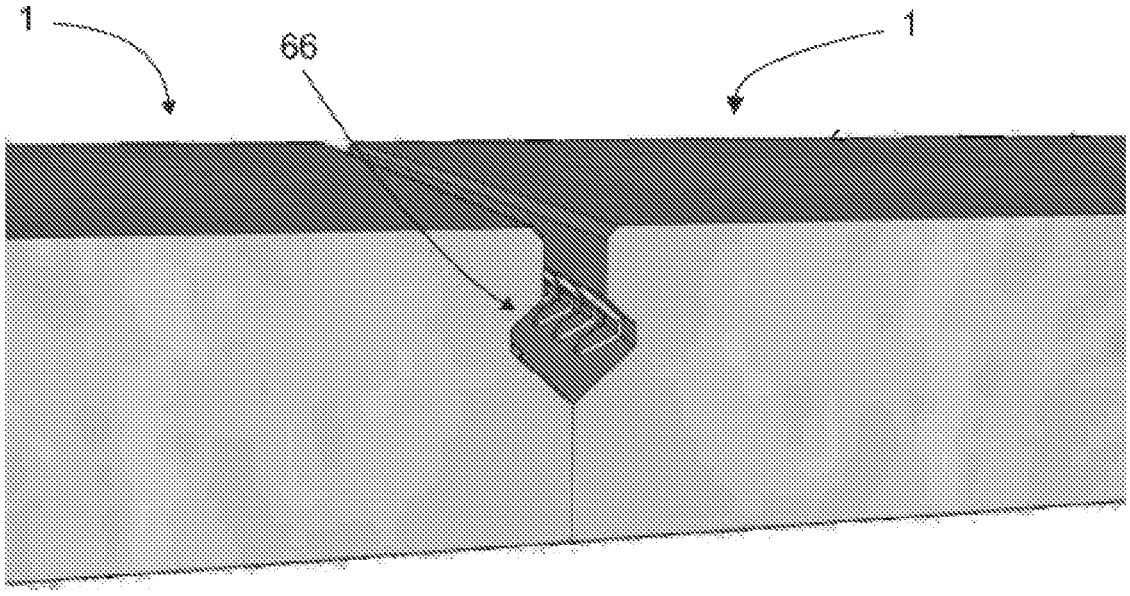
FIG. 19 shows an end perspective cross sectional view of the sides where like panels meet.
Figure 20:
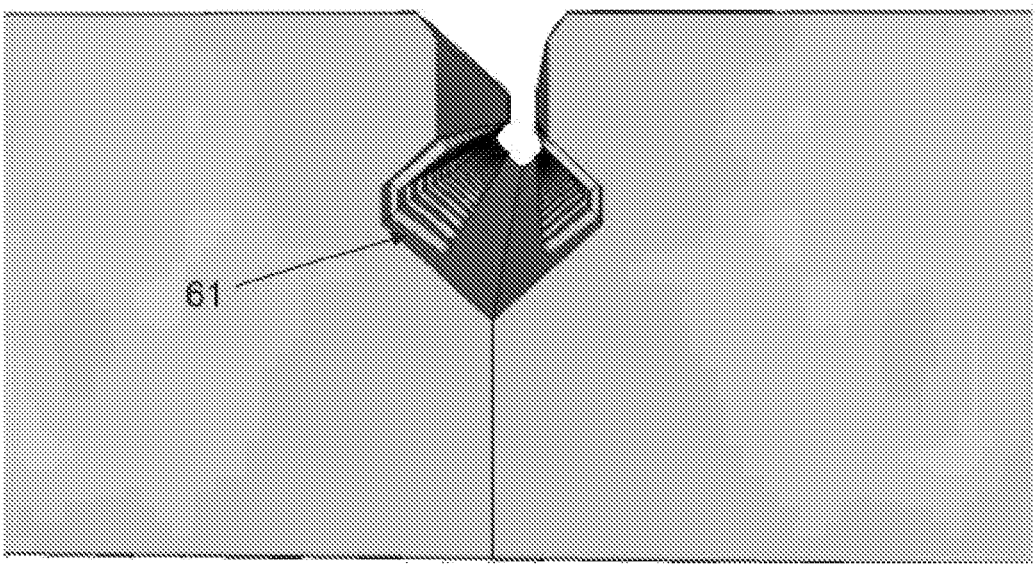
FIG. 20 shows an alternative view to FIG. 19.
Figure 21:
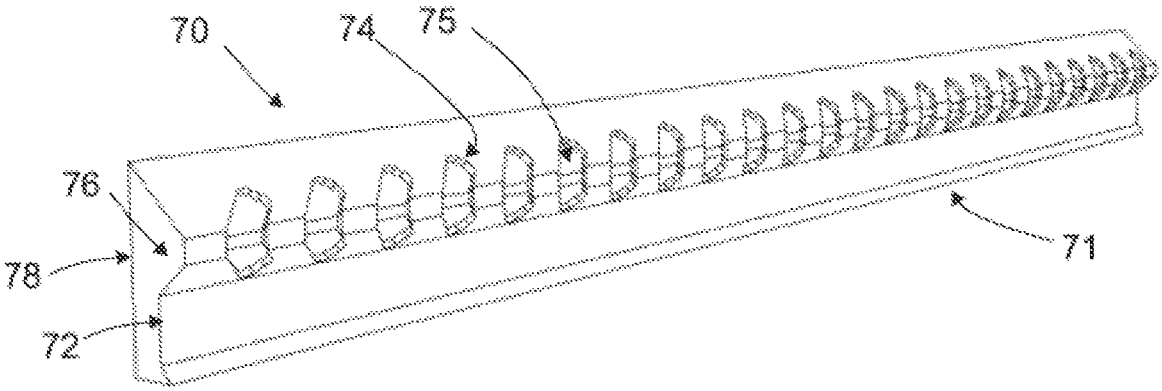
FIG. 21 shows a side perspective view of a moulding.
Figure 22:
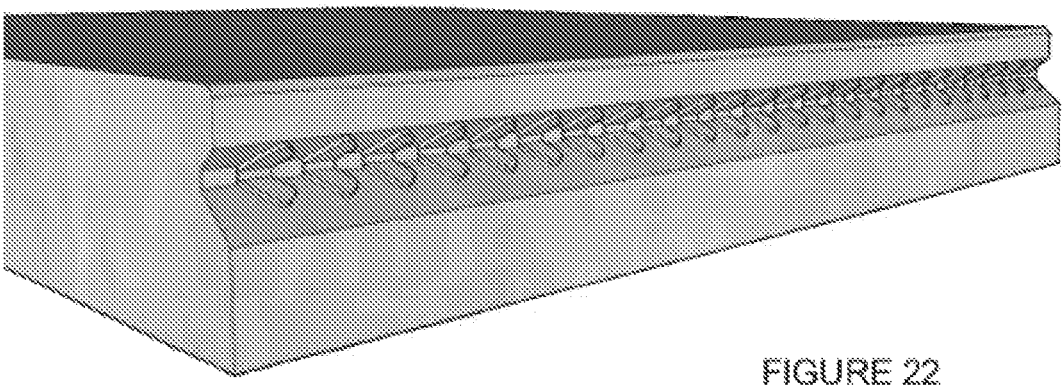
FIG. 22 shows a side perspective view of a side of a panel.
Figure 23:
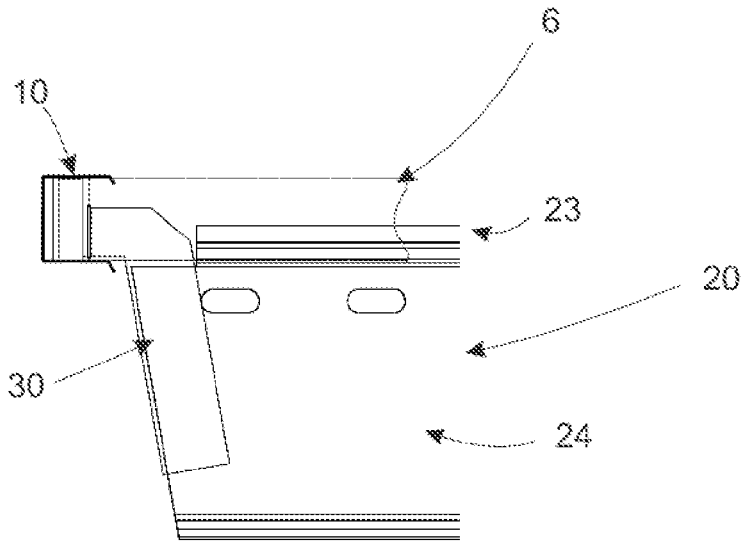
FIG. 23 shows a side cross section of the panel and assembly highlighting the settable material engagement with the joist and end cap.

FIGS. 12 to 17 show a panel 1, or for clarity, an assembly 7, being used in use with multiple different types of building constructions 5. FIG. 12 shows a bottom perspective view of a panel installed between steel columns, with the slab cutaway for clarity, and a ceiling installed below the joist. FIG. 13 says a top perspective view of an assembly with an end cap is being supported by a beam. FIG. 14 shows a top perspective view of a panel being supported by a flange connected to a concrete wall. FIG. 15 shows a top perspective view with a panel being supported by a timber framing, with the slab cutaway for clarity. FIG. 16 shows a top perspective view with a panel being supported by concrete blocks, with the slab cutaway for clarity. FIG. 17 shows a top perspective view of a building 5 comprising multiple panels.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A building panel to be supported, the building panel comprising:

two spaced apart elongate metal C-shaped end caps parallel each other, each end cap having a top and bottom flange, and a side wall opposite an opening and intermediate the top and bottom flange, each end cap comprising at least one pair of coaxial holes located on the top flange and bottom flange, at least one metal joist spanning between the two end caps, at least two hangers, one hanger intermediate each end of the joist and the respective end cap, to couple the joist to the end caps, each hanger comprising, a passage-defining hanger member engaged between said at least one pair of coaxial holes, the hanger member defining a passage intermediate the top flange and bottom flange, and a hanger flange extending off the hanger member and engaged with the joist, and a slab cast about a portion of the joist, hanger member, portion of the hanger flange, and cast through the openings of end caps that face each other, wherein the slab is composed of set concrete and has a top face, a bottom face opposite and generally parallel the top face, and two side walls intermediate the end caps, and each side wall of the slab comprises an indent and protrusions extending outwards from the indent, the indent comprising a channel along the side wall.

2. The panel as claimed in claim 1, wherein the indent and protrusions are configured to resist movement in at least three orthogonal directions when the indent is filled with a rigid material and is located directly adjacent a like side wall of a like panel.

3. The panel as claimed in claim 1, wherein each end cap further comprises at least one mounting member intermediate the top flange and the bottom flange and defining a further passage therebetween, the mounting member being cast with or welded to the end cap.

4. The panel as claimed in claim 3, wherein the end cap comprises recesses at each end of either or both of the mounting member and hanger member, to allow fasteners to sit flush with at least one or both of the top flange and the bottom flange.

5. The panel as claimed in claim 1, wherein the hanger member can rotate relative to the end cap.

6. The panel as claimed in claim 1, wherein the hanger flange is removably coupled to the joist.

7. The panel as claimed in claim 1, wherein the joist depth is greater than the slab depth.

8. The panel as claimed in claim 1, wherein the hanger flange extends outside the opening, and past the bottom flange.

9. The panel as claimed in claim 1, wherein a portion of the joist is below the bottom flange.

10. The panel as claimed in claim 1, wherein a portion of the joist is not set in the slab.

11. The panel as claimed in claim 10, wherein the portion of the joist not set in the slab extends along the majority of the length of the slab.

12. A kit of parts for forming an assembly for a building panel as claimed in claim 1, the kit of parts comprising:

the two elongate metal C-shaped end caps opposite and parallel each other, the at least one metal joist, and the two hangers.

13. The kit of parts as claimed in claim 12, wherein the kit of parts comprises formwork configured to extend between the end caps.

14. The kit of parts as claimed in claim 13, wherein the assembly is configured to contain a settable material defined by a periphery created when the end caps and formwork are arranged in a polygonal shape.

15. A structure comprising two or more building panels as claimed in claim 1, wherein two panels are laterally adjacent such that two side walls of the slabs of the panels are adjacent and facing each other, and the structure comprises a shear lock formed by grout set within a gap formed between the indents of the adjacent side walls.

16. The structure as claimed in claim 15, wherein the shear lock resists movement between adjacent panels in at least three directions orthogonal to each other.

17. The panel as claimed in claim 1, wherein for each passage-defining hanger member, and the at least one pair of coaxial holes engaged therewith, the passage is formed through the slab between the top and bottom flange.

* * * * *